United States Patent [19]

Rippe

[11] Patent Number: 4,708,528

[45] Date of Patent: Nov. 24, 1987

[54] PROCESS AND APPARATUS FOR STABILIZING FOUNDATIONS

[75] Inventor: Dondeville M. Rippe, Eureka, Mo.

[73] Assignee: Magnum Piering, Inc., St. Louis, Mo.

[21] Appl. No.: 940,853

[22] Filed: Dec. 12, 1986

Related U.S. Application Data

[63] Continuation-in-part of Ser. No. 803,740, Dec. 2, 1985, abandoned.

[51] Int. Cl.[4] ..... E02D 5/00; E02D 17/02

[52] U.S. Cl. ..... 405/230; 254/29 R

[58] Field of Search ..... 405/229–232, 405/250–253; 254/29 R; 403/292, 298; 285/370, 382, 397; 52/126.1, 170, 726

[56] References Cited

U.S. PATENT DOCUMENTS

| | | | |
|---|---|---|---|
| 1,906,136 | 4/1933 | Dahren . | |
| 2,853,858 | 9/1958 | Mintz . | |
| 2,982,103 | 5/1961 | Revesz et al. . | |
| 3,796,055 | 3/1974 | Mahony . | |
| 3,852,970 | 12/1974 | Cassidy | 405/230 |
| 3,902,326 | 9/1975 | Langenbach . | |
| 4,070,867 | 1/1978 | Cassidy | 405/230 X |
| 4,088,414 | 5/1978 | Fallein | 403/292 X |
| 4,100,713 | 7/1978 | Shoe | 403/292 X |

*Primary Examiner*—Cornelius J. Husar
*Assistant Examiner*—Nancy J. Stodola
*Attorney, Agent, or Firm*—Gravely, Lieder & Woodruff

[57] ABSTRACT

A foundation is stabilized with a pier that extends downwardly from the foundation into the underlying surface material and at its lower end preferably bears against bedrock. At its upper end the pier is attached to the foundation through a bracket having a sleeve and a rod directed generally radially from the sleeve. To drive the pier, a hole is first drilled into the foundation wall, and the rod of the bracket is inserted into the hole, so that the sleeve lies along the wall. A jacking apparatus is fitted to the bracket, and it includes a lift member that actually engages the sleeve and a hydraulic cylinder that is located above the lift member and sleeve. The pier comprises sections which are fitted individually into the sleeve and are driven downwardly with the cylinder, with all but the first section being coupled to the section immediately below it. As the downwardly directed force is applied by the cylinder an upwardly directed reaction force is exerted on the sleeve of the bracket, and this force is transmitted to the wall through the rod. Eventually the pier encounters bedrock or other firm resistance, at which time the uppermost pier section is secured permanently to the sleeve of the bracket so as to support the foundation wall.

24 Claims, 11 Drawing Figures

FIG. 1
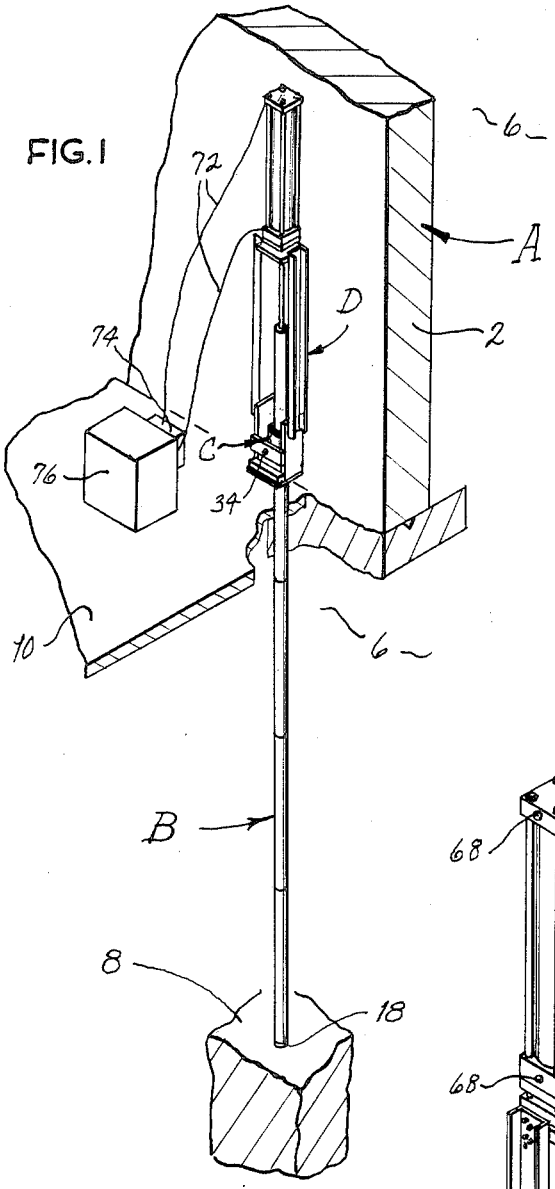
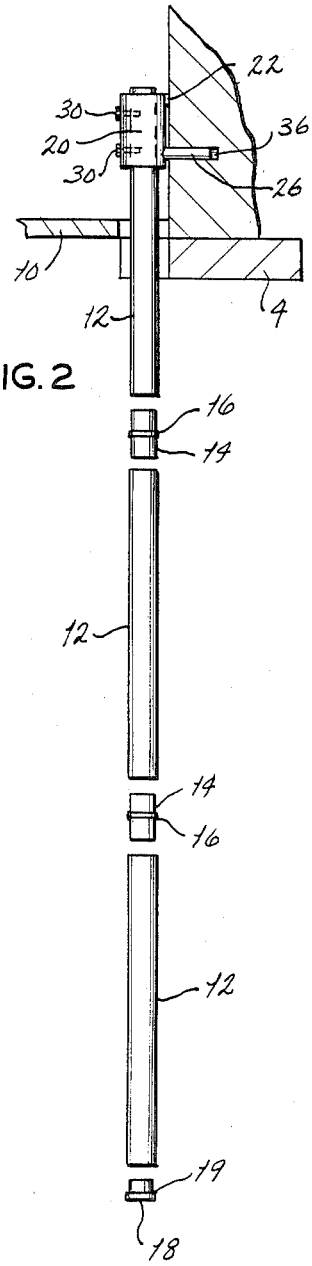
FIG. 2
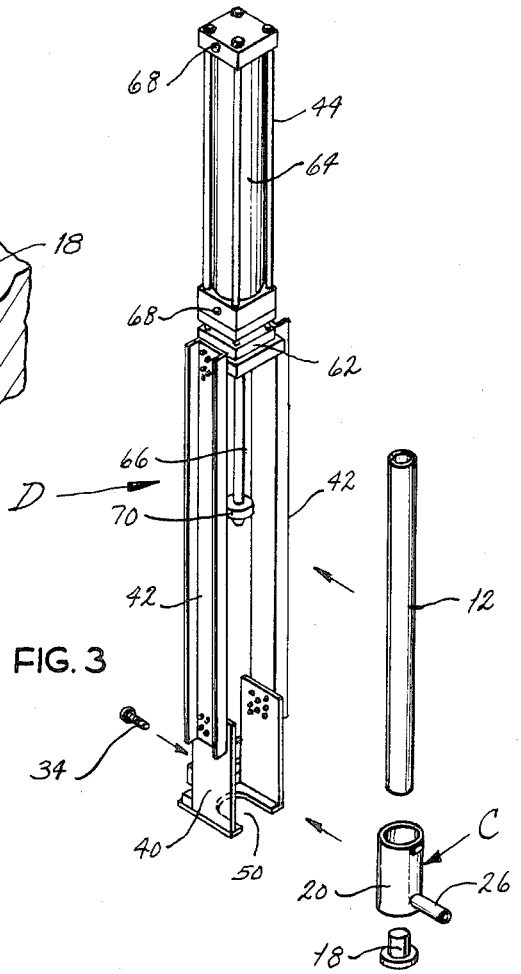
FIG. 3

PROCESS AND APPARATUS FOR STABILIZING FOUNDATIONS

RELATED APPLICATION

This application is a continuation-in-part of pending application Ser. No. 803,740 of Dondeville M. Rippe filed Dec. 2, 1985, now abandoned.

BACKGROUND OF THE INVENTION

This invention relates in general to foundations for buildings and similar structures, and more particularly to an apparatus and process for shoring such foundations.

Traditional procedures for shoring building foundations are for the most part quite complex and costly in that they rely on poured concrete piers. Moreover, these procedures require considerable excavation which often damages shrubbery and lawns around the buildings at which they are installed.

U.S. Pat. No. 3,902,326 to George Langenbach discloses a less complicated and less costly process for shoring foundations, but that process presents problems of a different nature. In particular, the process involves exposing the footing at several locations along the foundation, and indeed tunneling beneath the footing, so that a jacking bracket may be installed against the bottom of the footing. Then a pier is advanced through the bracket and driven into the underlying soil with a jacking device that attaches to the bracket. When the pier encounters bedrock, the reaction force exerted through the bracket against the foundation stabilizes the foundation and indeed may be increased enough to actually lift and reposition the foundation. However, to insure that the jacking bracket seats properly against the footing, the underside of the foundation must often be chiseled flat or otherwise squared off with respect to the vertical. Indeed, an inclined seating surface on the bottom of the foundation will cause the jacking bracket to skew and perhaps slip off of the foundation when the jacking force is applied to it. Also, a skewed jacking bracket may drive the upper end of the hydraulic jacking cylinder into the foundation wall, causing the rod of the cylinder to deflect and perhaps break. Chiseling a flat surface on the underside of a foundation requires a considerable amount of skill and dexterity, considering that the work is often performed through a small hole in a basement floor without opportunity for visual inspection of the surface that is chiseled.

Even when the jacking bracket of the Langenbach patent is seated properly against the underside of the footing, high lifting forces applied through the bracket to the footing cause the footing to crumble along its outer edge, and this also causes the bracket to skew and tilt the jacking equipment toward the foundation wall. Again the jacking cylinder does not align with the pier and excessive bending stresses develop in it.

Perhaps the most convenient location at which to employ the stabilizing procedure of the Langenbach patent is in the basement of a building that is being stabilized, assuming of course that the building has a basement, for that avoids what otherwise would amount to considerable excavation at the exterior of the foundation. Even though the holes in comparison to the overall basement may be small, they still require some excavation beneath the foundation and in adjoining regions.

SUMMARY OF THE INVENTION

One of the principal objects of the present invention is to provide a process for stabilizing a foundation with a minimal amount of effort and cost. Another object is to provide a process of the type stated which may be practiced along either the exterior or interior surface of a foundation wall, and when the former, requires a minimum amount of excavation, and when the latter, requires minimum disruption to a basement floor. A further object is to provide a process of the type stated which utilizes a jacking bracket and a hydraulic jack attached to the bracket for forcing a pier through the bracket, yet the bracket and pier do not tend to skew upon the application of force, thus avoiding substantial bending stresses in the jack. An additional object is to provide an improved apparatus for stabilizing foundations, which apparatus utilizes the process of the type described. These and other objects and advantages will become apparent hereinafter.

DESCRIPTION OF THE DRAWINGS

In the accompanying drawings which form part of the specification and wherein like numerals and letters refer to like parts wherever they occur.

FIG. 1 is a perspective view of an apparatus constructed in accordance with the present invention for driving a pier used to stabilize a foundation;

FIG. 2 is a sectional view showing the pier in exploded view and attached to a bracket which is engaged with a foundation wall;

FIG. 3 is a perspective view of the jacking apparatus, the bracket and a pier section;

DETAILED DESCRIPTION

Figure 4:
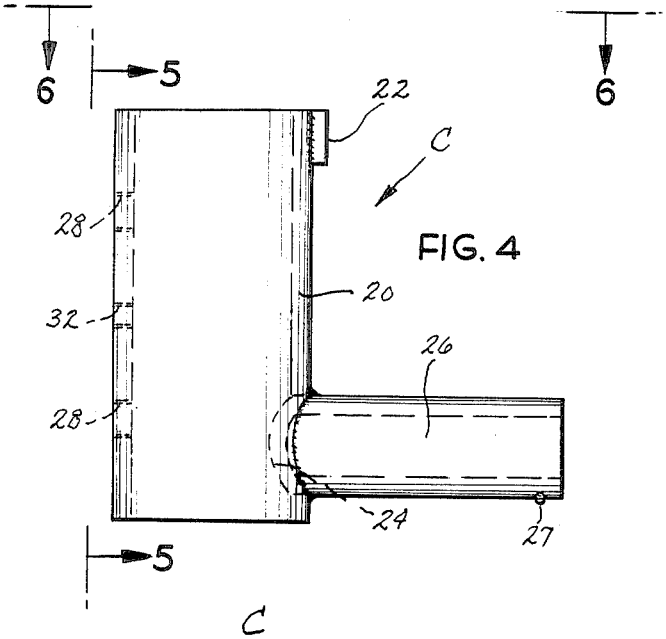
FIG. 4 is a side elevational view of the bracket through which the pier is engaged with the foundation wall.

Referring now to the drawings (FIG. 1), a building which may be a typical residence or low rise commercial structure, has a foundation A that is comprised essentially of a wall 2 and a footing 4 on which the wall 2 rests. The footing 4 is wider than the foundation wall 2, so as to distribute the weight of the building over an underlying surface material, such as soil or sand. Normally the footing 4 is poured concrete, whereas the foundation wall may be poured concrete, preferably containing reinforcing bars. The surface material 6 in turn overlies a layer of bedrock 8. Thus, the foundation 2 in contrast to the foundations of high rise structures which rest on piers sunk to the bedrock, merely rests on the surface material 6, in effect, floating on the surface material 6.

The surface material 6, although highly compacted, is nevertheless considerably less stable than the bedrock 8, and may from time to time shift, this being particularly true of the clay-like soils found in the midwestern states of the country. Indeed, droughts have been known to cause considerable shrinkage in this type of surface material 6. Of course, any shift in the surface material 6 beneath the foundation A will cause the foundation A to move, or perhaps more accurately, cause one portion to settle more than others. One result is cracks in the foundation.

If the building A has a basement, as most do, the foundation wall 2 will form the outside wall of that basement, it having one surface that is presented inwardly toward the basement and another that is presented outwardly. Usually, the soil or surface material 6 extends upwardly along and covers much of the outside surface of the foundation wall 2, although this part of the surface material 6 does not support the footing 4. The basement has a poured concrete floor 10 which along its perimeter extends over the footing 4 and comes against the inside surface of the wall 2. The foundation A may also enclose merely a crawl space in which case its wall 2 is accessible likewise both from inside or outside of the building, or the foundation A may extend along the periphery of a poured concrete slab, in which case its wall is only accessible along the outside surface of it.

Should a portion of the foundation A settle, that portion may be shored with a pier B (FIGS. 1 & 2) that is attached to the displaced portion of the foundation A with a bracket C and extends from the bracket C downwardly through the underlying surface material 6 preferably to the bedrock 8. The bracket C fits into the foundation wall 2, and once it is emplaced, the pier B is forced through it with a jacking apparatus D that engages the bracket C. Once the pier B reaches the bedrock 8, the bracket C may be secured to the pier B to stabilize the foundation A, or the jacking may be continued so that the reaction force applied against the foundation A actually lifts the settled portion of the foundation A and brings it back closer to its original position.

The pier B consists of a plurality of pier sections 12 (FIGS. 1 & 2) which are fitted together end-to-end to provide the pier B with enough length to extend from the bracket C preferably to the bedrock 8. Each section 12 is nothing more than a pipe which is squared off at its ends and is small enough in diameter to slide easily through the bracket C and short enough to be accommodated by the jacking apparatus D. Steel pipe having an outside diameter of 3 inches and a wall thickness of $\frac{1}{8}$ inches is suitable.

In addition, the pier B includes couplings 14 (FIG. 2) which fit into the ends of the pier sections 12 to join them together end-to-end. Each coupling 14 is nothing more than a short sleeve that for most of its length is small enough to fit easily into the hollow ends of pier sections 12. However, intermediate its ends, the coupling 14 has an enlarged portion 16 which is slightly greater in diameter than the inside diameter of the pier sections 12, so that it can be forced into a pier section 12 with an interference fit. The coupling 14 is inserted into the end of a pier section 12 and advanced until the enlarged portion 16 comes to that end. The next pier section 12 is fitted over the opposite end of the coupling 14 and advanced until its end comes to the enlarged portion 16. Thus, at this point the ends of the two pier sections 12 are separated by generally the width of the enlarged portion 16. However, when the jacking force is applied, the ends of the adjacent pier sections 12 will be forced over the enlarged portion 16 and will indeed come together and abut, so that the pier A is continuous along its outwardly presented surface. The same effect may be achieved by welding within one end of each pier section 12 a smaller diameter tube that projects axially from that end and fits into the opposite end of the preceding pier section to keep the two pier sections 12 aligned.

Finally, the pier B at the end of its lowermost section 12 has a cap 18 (FIG. 2) which is fitted to that end and is at its lower end slightly larger in diameter than the outside diameter of the pier sections 12, perhaps by as much as $\frac{1}{8}$ inches. However, intermediate its ends the cap 18 has a shoulder 19, and above the shoulder 19 it is small enough to fit snugly into the end of the lowermost pier section 12 with the end edge of that pier section 12 being against the shoulder 19.

Using the jacking apparatus D (FIGS. 1 & 3) the pier B is forced through the surface material 6 beginning with the lowermost section 12 and its cap 18, and as it advances additional sections 12 are added to it at the jacking apparatus D.

Figure 5:
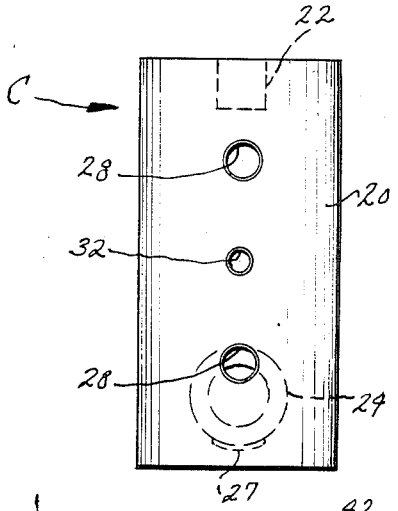
FIG. 5 is a rear elevational view of the bracket taken along line 5—5 of FIG. 4.
Figure 6:
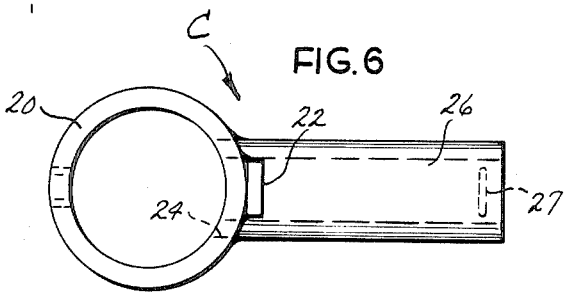
FIG. 6 is a top view of the bracket taken along line 6—6 of FIG. 4.

The bracket C includes (FIGS. 4–6) a vertical guide sleeve 20 which is preferably made from steel. The inside diameter of the sleeve 20 is slightly greater than the outside diameter of the sections 12 which comprise the pier B, so that the pier B slides easily within the sleeve 20 of the bracket C. Where the pipe from which the pier sections 12 are cut has an outside diameter of 3 inches, the inside diameter of the sleeve 20 should be about $3\frac{1}{8}$ inches. The length of the sleeve 20 should be at least twice its inside diameter and preferably more. For example, where the inside diameter is $3\frac{1}{8}$ inches, the preferred length of the sleeve 20 is about 8 inches. The wall thickness of the sleeve 20 should be at least $\frac{1}{4}$ inches and preferably $\frac{3}{8}$ inches.

Welded to the side wall of the sleeve 20 at its upper end is spacer 22 having a thickness of about $\frac{1}{4}$ inch. Directly below the spacer 22 near the bottom of the sleeve 20, the sleeve 20 is provided with a hole 24 which receives a lifting rod 26 that projects radially from the sleeve for perhaps 5 inches or more, with the axis of the rod 26 being perpendicular to the axis of the sleeve 20. The rod 26 and sleeve 20 are welded firmly together along the periphery of the hole 24. While the rod 26 fits into the hole 24, it does not project into the interior of the sleeve 20, but instead its inner end is machined flush with the inside cylindrical surface of the sleeve 20. On its underside near its outer end, the lift rod 26 may be provided with a slight protrusion 27 which may take the form of a weld bead which extends beyond the surface of the tube about $\frac{1}{8}$ inches, but the protrusion 27 is not critical to the operation of the bracket C. Where the sleeve 20 has an inside diameter of $3\frac{1}{8}$ inches, the lift rod 26 may have an outside diameter of 2 inches. Preferably, the rod 26 is solid and circular in cross-sectional configuration, although it may be of polygonal cross-sectional configuration, such as square, as well.

The spacer 22 and lift rod 26 project from the front face of the sleeve 20, that is the surface of the sleeve 20 which is presented toward the foundation wall when the bracket C is engaged with the wall 2. Along its back face, the sleeve 20 has a pair of threaded holes 28 which are spaced apart axially and receive bolts 30 (FIG. 2) that thread into the pier B to secure the bracket C to the pier B once the foundation A is stabilized at the desired elevation. In addition, the back face of the sleeve 20 contains another threaded hole 32 into which a bolt 34 (FIG. 1) threads for securing the jacking apparatus D to the bracket C, so that the jacking apparatus D may apply a downwardly directed force to the pier A and an upwardly directed reaction force to the bracket C.

The upwardly directed reaction force is resisted by the foundation A with which the bracket C is engaged. In this regard, the foundation wall 2, somewhat above the footing 4, is provided with a circular hole 36 (FIG. 2) which is slightly greater in diameter than the outside diameter or greatest width of the lift rod 26, and slightly longer than the extension of the rod 26 from the sleeve 20. The lift rod 26 may have a diameter of 2 inches, and to provide the hole 36 for accommodating the rod 26, a 2 inch diameter concrete bit having tungstun carbide tips is chucked into and rotated by a so-called impact drill, that is a drill which delivers impacts to the bit as it rotates the bit with of course the end of the bit at the location on the foundation wall 2 where the hole 36 is desired. The axis of the hole 36 should be perpendicular to the face of the wall 2 or cocked slightly so that the inner or closed end of the hole 36 is slightly above the open end.

The rod 26 fits relatively snugly into the hole 36 (FIG. 2), and indeed is forced into the hole as far as possible, thereby bringing the spacer 22 close to or perhaps against that face of the wall out of which the hole 36 opens. Should the rod 26 have the slight protrusion 27, the protrusion 27 will tend to cock the rod 26 slightly in the hole 36 and thus the spacer 22 on the sleeve 20 may not come against the wall 2. If the hole 36 is inclined slightly, the inclination will have the same effect. In any event, when the jacking apparatus D applies an upwardly directed reaction force to the sleeve 20 of the bracket C, the protrusion 27, if it is present, will bite into the concrete of the wall 2 along the surface of the hole 36 so that the tube 26 is retained securely in the hole 36. Similarly, the spacer 22 will prevent the sleeve 20 from cocking to a position in which its axis converges upwardly toward the wall 2. In other words, the sleeve 20, notwithstanding the upwardly directed reaction force applied to it, always remains with its axis somewhat divergent upwardly with respect to the wall 2, or at least parallel to the wall 2.

The jacking apparatus D includes (FIG. 3) a lift member 40 which forms a cradle for holding the wall bracket C, a pair of tie bars 42 which extend upwardly from the lift member 40 with the space between the bars 42 being wide enough and long enough to receive a pier section 12, and a jack in the form of a hydraulic cylinder 44 attached to the upper ends of the tie bars 42. The tie bars 42, in effect, connect the lift member 40 with the cylinder 44, so that when the cylinder 44 exerts a downwardly directed force on the pier A, an equal and opposite reaction force is transferred to the lift member 40 and thence to the bracket C through the tie bars 42.

Figure 7:
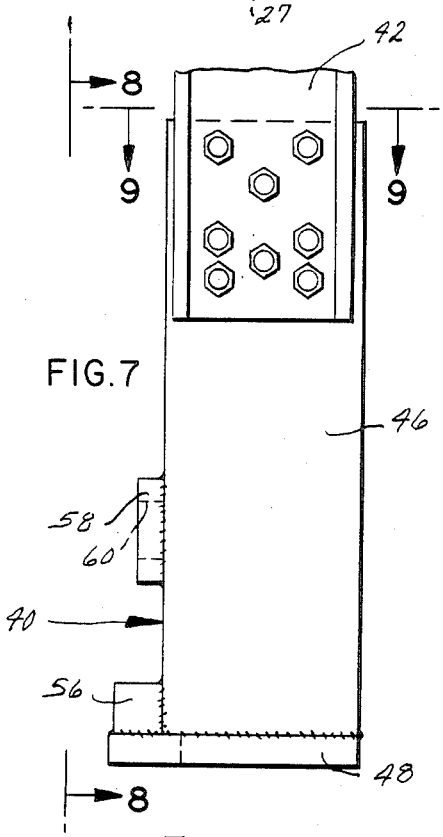
FIG. 7 is a side elevational view of the lifting member for the jacking apparatus.
Figure 8:
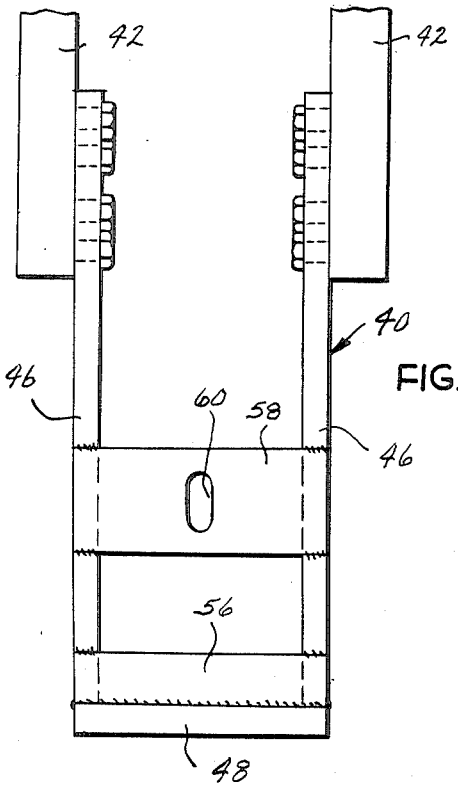
FIG. 8 is a rear elevational view of the lifting member taken along line 8—8 of FIG. 7.
Figure 9:
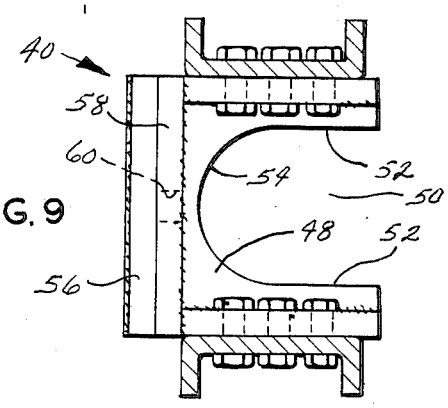
FIG. 9 is a top view of the lifting member taken along line 9—9 of FIG. 7.

Turning now to the lift member 40, it includes (FIGS. 7–9) a pair of side plates 46 which are parallel and spaced apart a distance only slightly greater than the outside diameter of the sleeve 20 for the wall bracket C. In addition, the lift member 40 has a bottom plate 48 that is welded firmly to the side plates 46 at their lower edges, it being perpendicular to the plates 46. The bottom plate 48 contains a C-shaped cut out 50 having parallel side margins 52 which are spaced apart a distance slightly greater than the diameter of the pier sections 12, and a curved margin 54 which merges into the side margins 50 and conforms to outside surface of the pier sections 12. While the C-shaped cut out 50 will accommodate the pier sections 12, it will not accommodate the sleeve 20 of the bracket C. Indeed, the bottom plate 48 by virtue of its C-shaped cut out 50 enables the sleeve 20 of the bracket C to rest in the lift member against the plate 48 while the pier B is driven through the bracket C (FIGS. 1 & 3). The bottom plate 48 extends no further forwardly than the front margins of the side plates 46, but projects rearwardly beyond the rear margins of those plates where a reinforcing bar 56 is welded to the side plates 46 and the bottom plate 48. Somewhat above the reinforcing bar 56 a cross piece 58 extends between the two side plates 46, it being welded to the side plates 46 at their rear edges. The forward faces of the reinforcing bar 56 and cross piece 58 lie in a plane which is positioned such with respect to the C-shaped cut out 50 in the bottom plate 48 that, when the sleeve 20 of the bracket C is between the two side plates 46 and against the reinforcing bar 56 and cross piece 58, the cylindrical interior of the sleeve 20 will axially align with the curved margin 54 of the cut out 50, so that the bottom plate 48 will underlie approximately the rear one-half of the sleeve 20. Moreover, the cross piece 58 contains an aperture 60 which aligns with the hole 32 in the sleeve 20 when the sleeve 20 rests on the bottom plate 48 with its lift rod 26 presented forwardly. The aperture 60 is large enough to receive the bolt 34 which threads into the hole 32 in the sleeve 20. Thus, the bolt 34 secures the bracket C within the lift member 40 and further positions it at the correct angular orientation. The bolt 34 although long enough to thread into the hole 32, does not extend totally through the hole 32, so it does not interfere with the pier B if the pier B is in the sleeve 20.

The side plates 46 of the lift member 40 are somewhat longer than the sleeve 20 of the lift bracket C, and in the region above that where the sleeve 20 fits, they are bolted to the tie bars 42 (FIG. 3). Indeed, the tie bars 42 are bolted to the outside faces of the side plates 46 and have flanges which are directed outwardly therefrom. This leaves adequate space for a pier section 12 to be placed between the two tie bars 42 and aligned with the sleeve 20. At their upper ends the tie bars 42 are bolted firmly to a spacer block 62 on which the hydraulic cylinder 44 is mounted.

The hydraulic cylinder 44 is for the most part conventional and as such includes (FIG. 3) a barrel 64 and a piston rod 66 which extends from the barrel 64. The cylinder 64, being double acting, has ports 68 at both ends of its barrel 64. The piston rod 66 extends through the spacer block 62, which is apertured to accommodate it, and below the block 62 is fitted with a head 70 that is configured to bear against the upper end of a pier section 12 and transmit a downwardly directed force from the piston rod 66 to the pier section 12. In this regard, the head 70 has a nose portion which is small enough to fit into the hollow interior of a pier section 12 and a flanged portion which bears against the end of the pier section 12 when the nose portion is so fitted.

The ports 68 of the hydraulic cylinder 44 are connected (FIG. 1) through hoses 72 and a control valve 74 to a hydraulic fluid under considerable pressure to the barrel 64 of the cylinder 44. The valve 74 determines which port 68 and of course the end of the barrel 64 to which the fluid is directed and from which fluid is returned to the reservoir of the unit.

Figure 10:
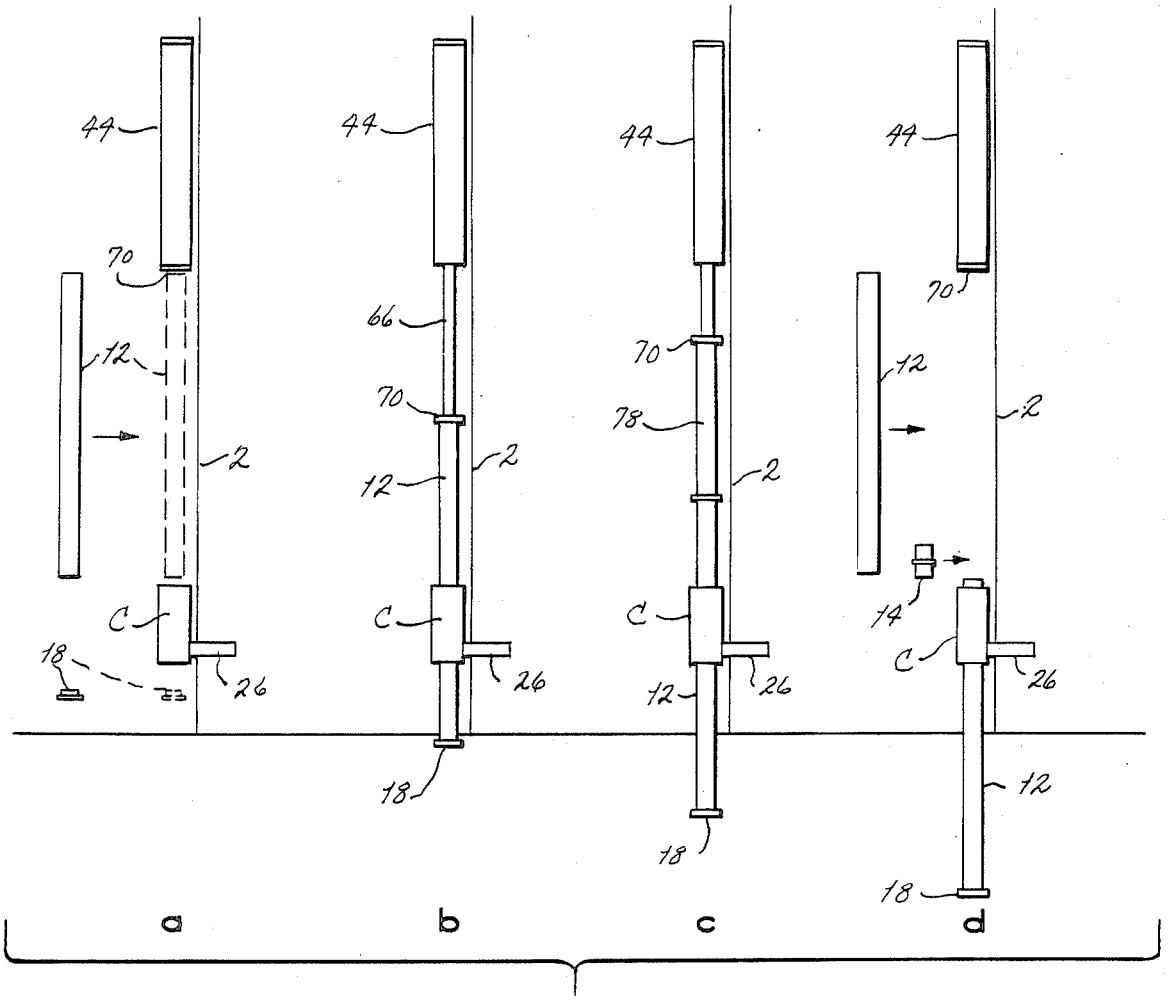
FIG. 10 is a schematic view showing sequentially the steps of driving a pier using the apparatus of the present invention.

The stroke of the piston rod 66 for the cylinder 44 is only slightly greater than one-half of the length of a pier section 12, and thus each extension of the piston rod 66 will drive the pier section 12 about one-half its length. To drive a pier section 12 its full length, a spacer 78 (FIG. 10*c*) is employed. In particular, the pier section 12 is first engaged directly at its end with the head 70 on the end of the piston rod 66 and driven one-half of its length (FIG. 10*b*). Then the piston rod 66 is retracted fully and the spacer 78 is inserted between its head 70 and the upper end of the spacer 12. When the piston rod 66 is again extended, it drives the pier section 12 the other one-half of its length (FIG. 10*c*). Thus, it generally takes two strokes of the piston rod 66 to drive a pier section 12 a distance equal to the length of that pier section 12.

OPERATION

In order to stabilize a displaced portion of the foundation A, an inspection of the foundation A is made to determine which surface of its wall 2 is more accessible in the region where the foundation has settled. In most instances it is the inside face. Within the region of the settlement, locations are selected at which to sink piers A for shoring the foundation A.

Using a bit tipped with tungstun carbide and chucked into a rotary impact drill, the holes 36 are drilled into the foundation wall 2 immediately above each location at which a pier A is desired. Each hole 36 is either horizontal or cocked slightly so that its end where it opens out of the wall 2 is slightly lower than its opposite end. Directly below each hole 36 the concrete floor 10 of the basement is broken away to expose the footing 4 which may be chiseled away with a jack hammer to provide an unobstructed path that extends along the foundation wall 2 through the footing 4 and into the underlying surface material 6.

A bracket C is installed on the wall 2 at each hole 36 by inserting the lift rod 26 of that bracket C into the hole 36 and advancing it until the sleeve 20 comes against the face of the wall 2 (FIG 10*a*).

Next the jacking apparatus D is coupled to the bracket C by inserting its lift member 40 over the sleeve 20 of the bracket C, such that the bottom plate 48 of the member 40 is against the bottom face of the sleeve 20 (FIGS. 1 & 3). To secure the lift member 40 to the bracket C, the bolt 34 is passed through the aperture 60 in the cross piece 58 of the former and threaded into the hole 32 of the latter.

As an alternative, the bracket C may be connected to the jacking apparatus D on the floor 10 of the basement and the two maneuvered as a unit along the wall 2 to insert the lift rod 26 of the bracket C into the hole 36 in the wall 2.

With the jacking apparatus D oriented in a vertical position and supported on the wall 2 by the bracket C, the first pier section 12 is inserted into the space between the tie bars 42 of the jacking apparatus D and aligned with the sleeve 20, through which it is allowed to descend (FIG. 10*a*). As the lower end of the first pier section 12 emerges from the sleeve 20, the cap 18 is fitted to it. The lower section 12 thereupon descends until the cap 18 at its lower end passes through the region where the footing 4 has been chiseled away and comes against the surface material 6 below the footing. At that time the control valve 74 is manipulated to direct pressurized fluid from the power unit 76 to the cap end of the hydraulic cylinder 44. The fluid drives the piston rod 66 downwardly, and as it descends, the pier section 12 is manipulated to align its upper end with the head 70 on the rod 66, so that the nose portion of the head 70 enters the hollow interior of the section 12 and the flange seats against the squared off upper end of the pier section 12 (FIG. 10*b*). The piston rod 66 thereupon drives the first section 12 downwardly into the underlying surface material 6. Should the bracket C be so high on the wall 2 as to allow the first section 12 to descend through the sleeve 20 under its own weight a distance more than one-half of its length, then the spacer 78 (FIG. 10*c*) must be inserted between the head 70 on the piston rod 66 and the upper end of the first section. In any event, the first section 12 is driven into the underlying surface material 6 until its upper end comes to the sleeve 20 on the bracket C.

Of course, as the downwardly directed force is applied to the first section 12 by the piston rod 66 an upwardly directed reaction force is transmitted through the tie bars 42 to the lift member 40 and thence to the bracket C, that reaction force being applied to the bottom edge of the sleeve 20 at the bottom plate 48 of the lift member C. The sleeve 20 transfers this reaction force to the lift rod 26, which being within the hole 36 in the foundation wall 2, transmits it to the foundation A. Thus, the jacking unit D jacks against the foundation A, even though it is located along the surface of the foundation wall 2.

Once the upper end of the first pier section 12 reaches the sleeve 20 of the bracket C, the piston rod 66 is retracted and the spacer 78 is withdrawn from the space between the two tie bars 42, thus exposing the upper end of the first pier section 12 at the sleeve 20. Next a coupling 14 is fitted into the upper end of the first pier section 12 and is pressed downwardly until its enlarged midportion 16 lodges in the upper end of the first pier section (FIG. 10*d*). Then another pier section 12 is maneuvered into the space between the two tie bars 42 and its lower end is fitted over the coupling 14 at the upper end of the first pier section 12. The second pier section 12 is allowed to descend until its lower end comes to the enlarged midsection 16 of the coupling 14. Thereupon, the upper end of the second pier section 12 is aligned with the head 70 on the piston rod 66, whereupon the cylinder 44 is again energized to drive its piston rod 66 downwardly. After a short distance the head of the piston rod 66 comes against and engages the upper end of the second pier 12, and the rod 66 thereafter drives the two pier sections 12 downwardly. When the piston rod 66 reaches its fully extended position, the rod 66 is retracted and the spacer 78 is thereupon inserted between the head 70 and the upper end of the second pier section 12. Upon further extension of the piston rod 66, the rod 66 drives the two pier sections 12 still further downwardly, indeed until the upper end of the second pier section comes to the sleeve 20.

Subsequent pier sections 12 are added and driven in the manner previously described, to in effect construct the pier A. As the pier A is assembled and driven one section 12 after the other, the cap 16 and all of the pier sections 12 above it advance through the surface material 6. Indeed, the cap 16, being slightly greater in diameter than the trailing pier sections 12 forms a tunnel through which those pier sections 12 pass with relative ease, for the surface material 6 is somewhat fluent and spreads apart to accommodate the advance of the cap 16. However, once the sinking of a pier A has commenced, it must be continued until the end cap 18 reaches the bedrock 6, for if it is halted for more than a few minutes, the fluent surface material 6 will close in about the pier a and create enough friction to prevent the pier A from being driven still further. Thus, the pier A is driven into the surface material 6 with only enough interruption in the advancement to add additional pier sections 12 and to emplace and withdraw the spacer 78. More and more pier sections 12 are added and driven into the surface material 6 until the end cap 16 on the first section 12 reaches and firmly contacts the bedrock 8 which is detected by an absence of further movement and an appreciable rise in pressure in the barrel 64 of the hydraulic cylinder 44.

In some regions of the country the bedrock 6 is so deep that it is impractical to construct and drive a pier A all the way to it. In that case, a so-called friction pier is driven. A friction pier is identical in structure to the pier A, but its end cap 16 does not rest on bedrock. Nevertheless the friction pier A is long enough to enable surrounding surface material 6, once that material settles in about the pier sections 12, to grip the pier A with enough friction to support the foundation A.

In any event, once the pier A is sunk to the desired depth, the pressure is maintained at the hydraulic cylinder 44. Indeed, the pressure within the barrel 64 may be increased to the extent necessary to actually lift the sunken portion of the foundation 6 and reposition at or close to its original position. Irrespective of whether the foundation A is actually raised or merely stabilized, an upwardly directed force is transmitted to it with this force being resisted by the bedrock 8 or at least by frictional forces on the pier A. The force, at this stage of the process is transmitted from the pier A through the jacking apparatus D to the bracket C, and of course is transferred to the foundation wall 2 at the lift rod 26 of the bracket C (FIG. 1).

The lifting force, once the foundation A is believed to be stabilized, is transmitted through the jacking apparatus D in the foregoing manner for about thirty minutes, and during this time the pressure within the barrel 64 of the hydraulic cylinder 44 is monitored. If the pressure remains constant during this time, then one can be reasonably assured that the pier A has indeed encountered the bedrock 8 or has at least encountered enough resistance to permanently stabilize the foundation A. Indeed, at this stage of the process more piers A may be driven in a like manner and then the hydraulic cylinders on the jacking apparatus D for all of the piers are connected so that the force exerted on all piers is the same. Once the determination that a pier B has encountered adequate resistance is made the bracket C around that pier A is secured permanently to the pier A.

To secure the bracket C permanently to the pier A, a hole is drilled into the wall of the last pier section 12 at each one of the threaded holes 28 in the sleeve 20 for the bracket C, each hole being slightly smaller in diameter than the sleeve hole 28 with which it aligns. Indeed, the threaded holes 28 are used as guides for the drill bit which is used to drill the holes in the pier section 12. Then the bolts 30 (FIG. 2) which are formed from high strength steel, are threaded into the holes 28, through which they pass to encounter the wall of the last pier section 12. The bolts 30 are turned down still further, so as to self thread into the holes in the last pier section 12. Thus, the bolts 30 firmly secure the bracket C to the pier A.

Once the bracket C is secured with the bolts 30, the piston rod 66 of the jacking apparatus D is retracted and the jacking apparatus D is removed from the bracket C, this being achieved merely by removing the bolt 34 and withdrawing the lift member 40 from the sleeve 20 of the bracket C. Finally, the last pier section 12 is cut off at the upper end of the sleeve 20, and the basement floor 10 is repaired with concrete in the region previously broken away to accommodate the pier A (FIG. 2).

The pier A and its bracket C may be installed from a crawl area as well, assuming enough head room exists for accommodating the jacking apparatus D. Similarly, the pier A and bracket C may be installed along the outside face of the foundation A. Where that face is covered with soil, that is the surface material 6, a slight excavation is made to gain access to the foundation. Since the bracket C is installed on the foundation wall 2, it may be placed near the top of the wall to reduce the excavation that is required. Furthermore, when the pier A is installed from a basement, the bracket C may be oriented in the position opposite to that illustrated, that is with its lift rod 26 near the top surface of its sleeve 20, and when so oriented, the bracket C is less prominent along the basement floor and wall.

Figure 11:
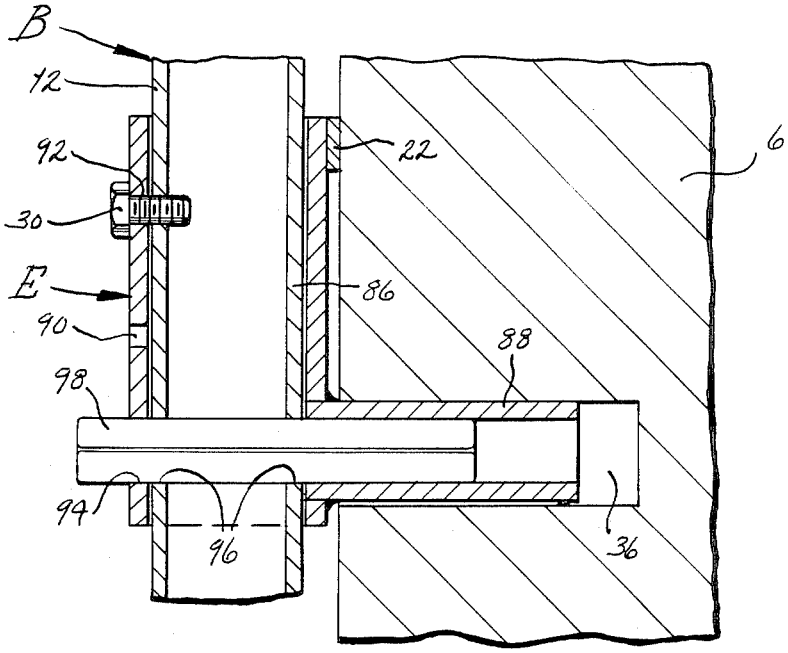
FIG. 11 is a sectional view of a modified bracket used to connect the pier to the foundation.

In lieu of the wall bracket C, a modified wall bracket E (FIG. 11) may be employed to transfer the supporting force from pier B to the foundation A. The modified bracket E likewise has a sleeve 86 and a lift rod 88 that is welded to the sleeve 86 and projects radially from it. In contrast to the rod 26, the rod 88 is hollow, but it is welded to its sleeve 86 in the same manner. The sleeve 86 has a threaded hole 90 for accommodating the bolt 34 that temporarily attaches the bracket E to the lift member 40 of the jacking apparatus D. It also has another threaded hole 92 for receiving a bolt 30 that pierces the wall of the pier A.

Finally, the sleeve 86 has a much larger hole 94 in its back face, with this hole being axially aligned with the tubular lift rod 88 and equal in diameter to the inside diameter of the rod 88. After the bolt 30 is threaded into the sleeve 86 and through the wall of the pier A, the last pier section 12 is provided with another hole 96 which passes completely through the pier section 12 and aligns with the hole 94 in the sleeve 86 and the hollow interior of the lift rod 88, it being equal in diameter to the hole 94 and interior of the rod 88. Indeed, the hole 94 is used as a guide for the bit which drills the hole 96. Thereupon, the aligned holes 94 and 96 are fitted with a roll pin 98 which is further driven into the interior of the tubular lift rod 88. The roll pin 98 will hold the rod 88, sleeve 86 and pier A together as a unit, even if the weld that connects the lift rod 88 to the sleeve 86 fails.

This invention is intended to cover all changes and modifications of the example of the invention herein chosen for purposes of the disclosure which do not constitute departures from the spirit and scope of the invention.

What is claimed is:

1. An apparatus for stabilizing a foundation which rests on an underlying surface material and includes an upright wall having a hole opening out of one of its faces, said apparatus comprising: a bracket including a sleeve having an axis and a single rod which is attached firmly to and projects generally radially from the sleeve, the rod being configured to fit snugly within the hole so as to locate the sleeve along that face of the wall out of which the hole opens, with the axis of the sleeve being presented generally vertically; a pier configured in cross-section to fit within and slide easily through the sleeve of the bracket and further being adapted to enter the surface material below the foundation; a jacking apparatus including a lift member and a jack connected to the lift member, the lift member being configured to engage the sleeve of the bracket such that an upwardly directed force may be applied to the sleeve in the direction of the axis of the sleeve, yet being detachable from the sleeve, the jack being located so as to bear against the pier when the pier is within the sleeve and to exert a downwardly directed force on the pier, with that force being resisted by an upwardly directed force applied to the sleeve at the lift member; and securing means for connecting the sleeve of the bracket to the pier so that the pier and the bracket will support the foundation when the jacking apparatus is detached from the bracket.

2. An apparatus according to claim 1 wherein the sleeve has a hole which receives one end of the rod and the rod is welded to the sleeve around the hole.

3. An apparatus according to claim 1 wherein the jacking apparatus in addition to the lift member and jack includes tie elements which are attached to and extend between the lift member and the jack, and the jack comprises a fluid-operated cylinder attached to the tie elements such that a space exists between the lift member and cylinder, the cylinder including a piston rod that extends into the space where it moves toward and away from the lift member and the bracket when the bracket is engaged with the lift member; and wherein the pier comprises a plurality of pier sections, each of which is small enough to fit into the space between the lift member and cylinder, and means for maintaining the pier sections in end-to-end alignment, whereby the sections may be inserted into the space to be added to the sections that are already driven.

4. An apparatus according to claim 3 wherein the pier also includes an end cap which is fitted to the lower end of the lowermost pier section and is slightly wider than the pier sections so as to form a path through which the pier sections easily pass.

5. An apparatus according to claim 1 wherein the pier comprises a plurality of tubular pier sections which are cylindrical in configuration and couplings which fit into the ends of the pier sections to join them end-to-end, each coupling being for the most part smaller in diameter than the inside diameters of the pier sections which it couples, but intermediate its ends having an enlarged portion which is slightly greater in diameter than the inside diameter of the pier sections so that when two pier sections are forced together with the coupling between them, the enlarged portion of the coupling will lodge in the inside of the two pier sections and the coupling will maintain the pier sections in alignment.

6. An apparatus according to claim 1 wherein the securing means comprises at least one bolt which threads into the sleeve of the bracket and projects into the pier.

7. An apparatus according to claim 1 wherein the rod of the bracket is hollow and the securing means includes a pin which extends through the sleeve of the bracket, through the pier, and into the hollow interior of the rod.

8. An apparatus according to claim 1 wherein the lift member includes lateral elements which extend along the sides of the sleeve of the bracket and a bottom element which lies beneath the sleeve but does not interfere with the pier when the pier extends through the bracket.

9. The combination comprising: a foundation that rests on a surface material and has a wall provided with at least one vertical surface and a generally horizontally extending hole that opens out of the vertical surface; a bracket including a sleeve that lies along the vertical surface of the foundation wall with its axis generally vertical and a single rod that is secured firmly to the sleeve and projects generally radially from the sleeve into the hole in the foundation wall; a pier extending generally vertically through the sleeve and into the surface material and being generally fixed against descent within the surface material; and means connecting the sleeve with the pier, so that the bracket at its rod exerts an upwardly directed supporting force on the foundation wall, whereby the wall is stabilized.

10. The combination according to claim 9 wherein means connecting the sleeve with the pier comprises a lift member engaged with the sleeve of the bracket, a fluid-operated cylinder spaced from the lift member and having a piston rod arranged to exert a downwardly directed force on the pier and to apply an upwardly directed reaction force to the bracket, with the reaction force being directed through the lift member.

11. The combination according to claim 10 wherein the cylinder is fixed in position with respect to the lift member and has a piston rod that is axially aligned with the sleeve in the lift member and is capable of moving toward and away from the sleeve, the piston rod at its end being configured to engage the end of the pier.

12. The combination according to claim 11 wherein the pier comprises a plurality of sections aligned end-to-end, with each section being short enough to fit into the space between the piston rod and the sleeve in the lift member when the piston rod is fully retracted.

13. The combination according to claim 9 wherein the pier comprises a plurality of hollow pier sections and coupling elements joining the sleeves together end-to-end, each coupling element being at its ends small enough to fit easily into the hollow interiors of the two pier sections that the coupling joins, but intermediate its ends having an enlarged portion which is slightly larger than the interiors of the two pier sections, so that the enlarged portion lodges in the ends of the two pier sections.

14. The combination according to claim 10 wherein the lift member comprises vertical side plates which are spaced apart a distance slightly greater than the width of the sleeve and are located on opposite sides of the sleeve, a bottom plate which is attached to the side plates and extends beneath the sleeve such that the sleeve is against the bottom plate, the bottom plate being contoured so that it does not interfere with the pier that extends through the sleeve, and a cross piece connecting the two side plates above the bottom plate and also being against the sleeve, whereby the side and bottom plates and the cross piece serve to locate the sleeve in the lift member.

15. The combination according to claim 14 and further comprising means for temporarily attaching the sleeve to the cross piece to hold the lift member on the bracket.

16. The combination according to claim 15 wherein the means for temporarily attaching the sleeve includes a bolt which extends through the cross piece of the bracket and threads into the sleeve.

17. The combination according to claim 9 wherein the means connecting the sleeve with the pier comprises a screw that threads through the sleeve and projects into the pier.

18. A process for stabilizing a foundation that rests on an underlying surface material and includes an upright wall having vertical surfaces, said process comprising: drilling a generally horizontal hole in the upright wall from one of its vertical surfaces; installing a bracket on the wall by inserting a single rod that forms part of the bracket into the hole, the bracket also including a sleeve to which the rod is firmly secured and from which it projects, the sleeve when the bracket is installed on the wall being generally along that vertical surface of the wall out of which the hole opens; inserting a pier through the sleeve so that the sleeve is directed downwardly along the wall to the surface material on which the foundation rests; contemporaneously applying a downwardly directed force to the pier and a generally equal and opposite reaction force to the bracket, so that the pier is forced downwardly into the surface material; and when the pier encounters a desired amount of resistance, securing the pier to the sleeve of the bracket so that the pier operating through the bracket lends support to the foundation.

19. The process according to claim 18 wherein the lift member is configured to form a cradle for the sleeve of the bracket, and the step of engaging the lift member with the sleeve comprises fitting the lift member beneath and along the sleeve of the bracket.

20. The process according to claim 18 wherein the step of securing the pier to the sleeve comprises threading a screw radially through the sleeve and into the pier.

21. The process according to claim 18 wherein the contemporaneous steps of applying a downwardly directed force to the pier and an upwardly directed reaction force to the bracket include engaging a lift member with the sleeve of the bracket, the lift member having a fluid-operated cylinder attached to it, and with the cylinder, exerting the downwardly directed force on the pier such that the reaction force is transmitted to the sleeve and applied to the bracket.

22. The process according to claim 18 wherein the pier comprises a plurality of pier sections fitted together end-to-end, and the downwardly directed force is always applied to the uppermost pier section.

23. An apparatus according to claim 1 wherein the single rod which projects from the sleeve of the bracket is circular in cross-section.

24. The process according to claim 18 wherein the single rod that forms part of the bracket is circular in cross-section.

* * * * *